United States Patent [19]

Bruni et al.

[11] 4,297,976

[45] Nov. 3, 1981

[54] PISTON AND CYLINDER ASSEMBLIES

[75] Inventors: Ludovico Bruni; Pierantonio Iguera, both of Turin, Italy

[73] Assignee: Associated Engineering, Italy, S.p.A., Turin, Italy

[21] Appl. No.: 44,074

[22] Filed: May 31, 1979

[30] Foreign Application Priority Data

May 31, 1978 [GB] United Kingdom ..... 25336/78

[51] Int. Cl.[3] ..... F02F 1/00

[52] U.S. Cl. ..... 123/193 CP; 75/140; 75/142; 92/169; 123/193 C

[58] Field of Search ..... 75/142, 140; 92/169, 92/222; 123/193 C, 193 CH, 193 CP

[56] References Cited

U.S. PATENT DOCUMENTS 2,357,450 9/1944 Bonsack ..... 75/142

2,357,451 9/1944 Bonsack ..... 75/142

*Primary Examiner*—R. Dean

[57] ABSTRACT

In a piston and cylinder assembly in which the piston is made of an aluminium alloy, the wall of the cylinder contacted by the piston is formed of a hyper-eutectic silicon aluminium alloy having the composition by weight percentages of silicon (Si) 12–20%; copper (Cu) 0.5–5%; iron (Fe) 1.0–6%; magnesium (Mg) 0.2–2%; nickel (Ni) 0.5–4%; and optionally manganese (Mn) 0–5%; cobalt (Co) 0–3%; chromium (Cr) 0–3%; tin (Sn) 0–8%; titanium (Ti) 0–0.3%; lead (Pb) 0–5%; and molybdenum (Mo) 0–5%, the remainder being aluminium.

11 Claims, No Drawings

PISTON AND CYLINDER ASSEMBLIES

BACKGROUND OF THE INVENTION

This invention relates to piston and cylinder assemblies, particularly, but not exclusively for internal combustion engines or reciprocating compressors, in which the piston is made of aluminium alloy.

Aluminium-base alloys suitable for use in the manufacture of pistons and other motor parts are described in British Pat. Nos. 334,656 and 480,499, in U.S. Pat. No. 2,357,450 and in French Pat. No. 998,474.

An object of the present invention is to provide a piston and cylinder assembly of which not only is the piston made of aluminium alloy, but the cylinder wall, forming part of the cylinder block or of a cylinder liner, is also made of aluminium alloy and in which the aluminium alloy piston can run directly on the aluminium alloy cylinder wall without the interposition therebetween of a permanent protective coating of another, e.g. harder, metal.

The problem of providing a suitable aluminium cylinder liner material in which to run an aluminium alloy piston has received considerable attention. For example, the Chevrolet Vega cylinder block is manufactured in a Reynolds Metals 17% silicon aluminium alloy, the running surface of the cylinder being given a special chemical etching treatment and the piston being iron-plated. It is also known to produce air-cooled aluminium alloy cylinders in 12% silicon aluminium alloy in which the running surface of the cylinder is coated with electroplated nickel and silicon carbide.

Rig tests using an aluminium alloy with a composition of 18.33% silicon; 1.48% nickel; 1.49% copper; 1.20% magnesium; 0.40% iron, after solution and precipitation heat treatment, running against a test bar of pseudo-eutectic aluminium alloy having a composition of 11.46% silicon; 1% nickel; 1.13% copper; 0.91% magnesium; 0.17% iron, after solution and precipitation heat treatment, resulted in seizure occurring between the two components.

BRIEF SUMMARY OF THE INVENTION

The object of the present invention of providing a piston and cylinder assembly in which both the piston and the cylinder wall are made of aluminium alloy is achieved in that the wall of the cylinder contacted by the piston is formed of a hyper-eutectic silicon aluminium alloy having the composition by weight percentages of silicon (Si) 12–20%; copper (Cu) 0.5–5%; iron (Fe) 1.0–6%; magnesium (Mg) 0.2–2%; nickel (Ni) 0.5–4%; and optionally manganese (Mn) 0–5%; cobalt (Co) 0–3%; chromium (Cr) 0–3%; tin (Sn) 0–8%; titanium (Ti) 0–0.3%; lead (Pb) 0–5%; and molybdenum (Mo) 0–5%, the remainder being aluminium.

DETAILED DESCRIPTION

The alloy composition of the cylinder wall is closely similar to allow compositions described in the prior art referred to above, but the prior art did not teach the use of such alloy compositions for use in the construction of a cylinder wall on which an aluminium alloy piston would slide.

It has been found that, in an assembly of an aluminium alloy piston and a co-operating cylinder or cylinder liner of a hyper-eutectic silicon aluminium alloy as above defined, there can be direct contact between the two aluminium alloys of the piston and cylinder during operation, apart from lubricating oil and/or a running-in coating.

No chromium plating or similar long-term special treatment is required, though for the purpose of running-in, either the piston or the cylinder bore may be plated or otherwise coated with tin, graphite, or a similar material. Such running-in coatings are well known, and are substantially worn away during the running-in period unlike, for example, electroplated iron or chromium which last for the whole life of the piston.

Examples of cylinder liners which have been tested have the following percentage compositions by weight:

| Example No. | 1 | 2 | 3 | 4 |
|---|---|---|---|---|
| silicon | 16 | 16 | 17 | 17.5 |
| copper | 3 | 3 | 3.5 | 3.5 |
| iron | 3 | 3 | 4 | 5 |
| magnesium | 1.3 | 1.3 | 1.2 | 1.2 |
| nickel | 2 | 2 | 2.3 | 2 |
| manganese | — | 0.8 | 0.05 | 1 |
| cobalt | — | 0.4 | 0.8 | 1 |
| chromium | — | 0.4 | 1 | 0.01 |
| tin | 2 | 2 | 4 | 0.3 |
| titanium | — | 0.2 | 0.3 | 0.3 |
| lead | — | — | — | 2 |
| molybdenum | — | — | — | — |
| aluminum | remainder | | | |

It has been found that this material, with a conventional cylinder liner finish, can be run in conjunction with pistons of the usual aluminium alloy materials with direct contact between the piston and cylinder liner (apart from the usual lubricating oil), no coating being required on either the piston or the cylinder.

Examples of the usual aluminium alloy piston materials include the pseudo-eutectic aluminium alloy containing 11.46% silicon (of which the full composition is given above); an aluminium alloy containing 12.6% silicon; 2.1% nickel; 1% copper; 1.2% magnesium; 0.15% titanium, and 0.4% iron; and also hyper-eutectic alloys having a composition, for example, 21% silicon; 1.4% copper; 1.5 nickel; 1.2% cobalt; 0.9% magnesium; 0.6% manganese; 0.5% iron; the remainder being aluminium.

This has the advantage that it allows the cylinder bore to be enlarged during overhaul of the engine by a simple diamond boring operation.

What is claimed is:

1. A piston and cylinder assembly in which the piston is made of an aluminium alloy characterised in that after any temporary running-in coating on the wall of the cylinder has been worn away, the piston is in direct running contact with a cylinder wall formed of a hyper-eutectic silicon aluminium alloy consisting essentially of the following in percentages by weight:

silicon 12–20%; copper 0.5–5%; iron 1.0–6%; magnesium 0.2–2%; nickel 0.5–4%; and optionally manganese 0–5%; cobalt 0–3%; chromium 0–3%; tin 0–8%; titanium 0–0.3%; lead 0–5%; and molybdenum 0–5%, the remainder being aluminium.

2. A piston and cylinder assembly according to claim 1 characterised in that the composition of said silicon aluminium alloy is silicon 14.5–18%; copper 2–3.5%; magnesium 1–1.5%; nickel 1.5–2.5%; manganese 0.01–3%; cobalt 0.01–3%; chromium 0.01–3%; tin 0.01–2%; titanium 0.01–0.25%; and optionally lead and molybdenum each up to 5%, the remainder being aluminium.

3. A piston and cylinder assembly according to claim 2 characterised in that said silicon aluminium alloy contains manganese in the range 0.01–1.5%; cobalt in the range 0.01–1.5%; and chromium in the range 0.01–1%.

4. A piston and cylinder assembly according to claim 1 characterised in that said silicon aluminium alloy consists essentially of silicon 14.5–18%; copper 2–3.5%; iron 2–4%; magnesium 1–1.5%; nickel 1.5–2.5%; manganese 0.4–2%; cobalt 0.4–1.5%; chromium 0.01–1%; tin 1.5–3%; titanium 0.01–0.25%; and optionally lead and molybdenum each up to 5%, the remainder being aluminium.

5. A piston and cylinder assembly according to claim 1 characterised in that said silicon aluminium alloy consists essentially of silicon 16%; copper 3%; iron 3%; magnesium 1.3%; nickel 2%; and tin 2%, the remainder being aluminium.

6. A piston and cylinder assembly according to any preceding claim characterised in that the composition of the aluminium alloy of the piston consists essentially of 11.46% of silicon; 1% nickel; 1–1.13% copper; 0.91% magnesium and 0.17% iron, the remainder being aluminium.

7. A piston and cylinder assembly according to any one of claims 1 or 2 to 5 characterised in that the composition of the alloy of the piston comprises 12.6% silicon; 2.1% nickel; 1% copper; 1.2% magnesium; 0.15% titanium and 0.4% iron, the remainder being aluminium.

8. A piston and cylinder assembly according to any one of claims 1 or 2 to 5 characterised in that the composition of the alloy of the piston comprises 21% silicon, 1.4% copper; 1.5% nickel; 1.2% cobalt; 0.9% magnesium; 0.6% manganese and 0.5% iron, the remainder being aluminium.

9. A piston and cylinder assembly according to claim 1 characterised in that the said silicon aluminium alloy consists essentially of silicon 16%; copper 3%; iron 3%; magnesium 1.3%; nickel 2%; manganese 0.8%; cobalt 0.4%: chromium 0.4%; tin 2%; and titanium 0.2%, the remainder being aluminium.

10. A piston and cylinder assembly according to claim 1 characterised in that the said silicon aluminium alloy consists essentially of silicon 17%; copper 3.5%; iron 4.0%; magnesium 1.2%; nickel 2.3%; manganese 0.05%; cobalt 0.8%; chromium 1%; tin 4%; titanium 0.3%, the remainder being aluminium.

11. A piston and cylinder assembly according to claim 1 characterised in that the said silicon aluminium alloy consists essentially of silicon 17.5%; copper 3.5%; iron 5%; magnesium 1.2%; nickel 2%; manganese 1%; cobalt 1%; chromium 0.01%; tin 0.3%; titanium 0.3%; and lead 2%, the remainder being aluminium.

* * * * *